US005107941A

United States Patent [19]

Gresham

[11] Patent Number: 5,107,941

[45] Date of Patent: Apr. 28, 1992

[54] KELLY SAVER DRIVE

[76] Inventor: William J. Gresham, 160 Stones Edge, Montgomery, Tex. 77356

[21] Appl. No.: 515,555

[22] Filed: Apr. 26, 1990

[51] Int. Cl.[5] ..... E21B 3/04; E21B 29/00

[52] U.S. Cl. ..... 175/195; 166/78; 173/165; 464/163

[58] Field of Search ..... 175/195, 170, 121; 464/163, 165; 173/165; 166/55.6, 78

[56] References Cited

U.S. PATENT DOCUMENTS

| | | | |
|---|---|---|---|
| 1,758,426 | 5/1930 | Black | 464/163 |
| 2,183,012 | 12/1939 | Davidson | 464/163 |
| 2,204,647 | 6/1940 | Baash | 464/163 X |
| 2,344,746 | 3/1944 | Spalding | 464/163 |
| 2,522,795 | 9/1950 | Mitchell | 173/165 X |
| 2,853,274 | 9/1958 | Collins | 173/165 X |
| 3,092,181 | 6/1963 | Alexander | 175/195 X |
| 3,527,064 | 9/1970 | Crickmer | 464/163 |
| 4,317,493 | 3/1982 | Thompson | 175/195 X |
| 4,325,233 | 4/1982 | Haynes | 175/195 |

*Primary Examiner*—Hoang C. Dang
*Attorney, Agent, or Firm*—Mary J. Gaskin

[57] ABSTRACT

A split, solid mass, drive bushing-drive plate for use when a kelly is used to sever a length of well casing. The invention fits into the master bushing and prevents wear on the corners between the flat sides of the kelly.

2 Claims, 3 Drawing Sheets

KELLY SAVER DRIVE

FIELD OF INVENTION

This invention relates to an apparatus used to prevent wear on the corners between the flat sides of a kelly drill, particularly when the kelly is used to sever a length of well casing.

BACKGROUND OF THE INVENTION

Presently, no known apparatus has either been proposed or is in use which solves the particular problem addressed by the present invention.

As is well-known, rotary drilling rigs are used to drill boreholes into subsurface earth formations for the purpose of recovering aqueous and petroleum fluids. The borehole is drilled with a large bit, and a length of steel well casing is installed. Cement is pumped around the annulus of the casing. A slightly smaller bit that will fit inside the first string of casing is then used to drill the borehole deeper. The second, longer string of casing is lowered into the borehole and is cut off even with the top of the first string of casing. Cement is pumped around the annulus of the casing up to the surface of the earth (leaving cement between the strings of casing). This process of drilling deeper and adding successively smaller strings of casing continues until the desired depth is reached. If hydrocarbons are found, the well is produced; if no production results, the well is abandoned.

The steel well casing is expensive, and attempts to extract as much casing as possible are made, either after abandonment of the well or after production is completed. Extraction is often accomplished only after severing the well casing. A casing cutter is installed on the end of the kelly drill or drill string and lowered into the casing. The kelly is rotated to cut the casing from the inside out. While cutting casing, the kelly is maintained at a fixed elevation. Thus, the rollers which engage the six flat surfaces of the kelly, are maintained at the same location along the length of the kelly during the cutting operation. This causes the rollers to roll over and wear down the corners between the six (or four) flat surfaces along the length of the kelly, damaging the kelly.

This type of damage to the kelly is a function of how long the rollers are driven about the circumference of the kelly at the same location along its length. During normal drilling operations, the wear on the kelly caused by the rollers is uniform up and down its length. However, during cutting operations, with the rollers operating at the same location for a period of five to six hours (with only occasional and routine interruptions), damage to the corners of the kelly is almost inevitable.

Replacement of the damaged kelly is an expensive and time-consuming operation. Operations must cease until another kelly is transported to the rig and installed.

The present invention was developed to prevent wear to the kelly during cutting operations.

SUMMARY OF THE INVENTION

The invention is a precision-machined, split, solid mass, drive bushing-drive plate. It is cast of steel or low hydrogen steel. In certain instances, it has four drive pins, one welded at each corner; the pins, made of T-2 steel, are calibrated for easy insertion into the preexisting holes in the master bushing. The cylindrical body of the invention below the drive plate is cast to match the ledge in the master bushing, where such a ledge exists.

The vertical center of the drive bushing-drive plate is cut out to fit the size and shape of the kelly being used. For example, hexagonal kellys would require a hexagonal hole from 3 to 6 inches in diameter; square kellys would require a square hole from 2.5 to 6 inches in diameter.

Utilization of the invention is simple. The kelly drive is moved upward on the kelly. The two piece invention is inserted in the master bushing around the kelly and lowered until it rests against the master bushing. The kelly drive is then lowered until it rests against the invention.

The invention will now be driving the kelly, with approximately 15 to 18 inches of surface contacting the same amount of surface on the kelly's flat surfaces. This greatly increased area prevents the corners of the kelly from being rounded off during the casing-cutting operation.

When the cutting operation is completed, the invention is removed and set aside until the next cutting operation.

DESCRIPTION OF THE PREFERRED EMBODIMENT

Figure 1A:
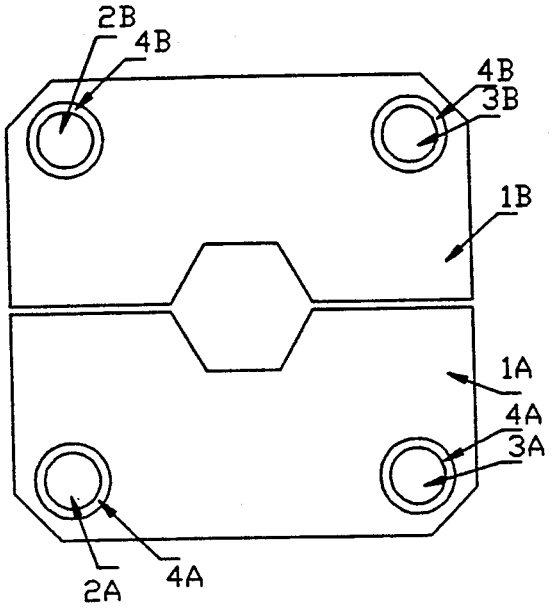
FIG. 1(*a*) is a top plan view and FIG. 1(*b*) a side perspective view of the invention, for use on a kelly with a hexagonal drill; the master bushing has pinholes and ledge.
Figure 1B:
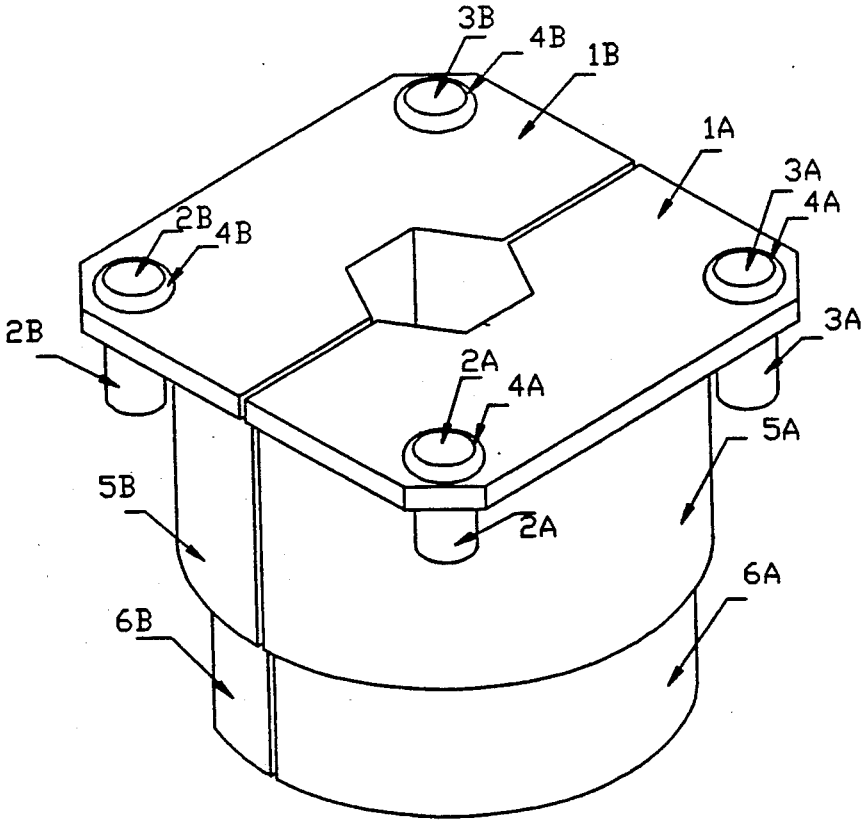

Referring to FIG. 1, a split, drive bushing-drive plate (1A, 1B) has a cylindrical extension block (5A, 5B) below the drive plate with a shoulder (6A, 6B) to match the ledge in the master bushing in the rotary table. The hexagonal vertical center (7A, 7B) of the drive bushing-drive plate fits the shape of the kelly being used. Four drive pins (2A, 2B, 3A, 3B), welded into place (at 4A, 4B), are calibrated to fit into the pin holes on the master bushing being used.

Figure 2A:
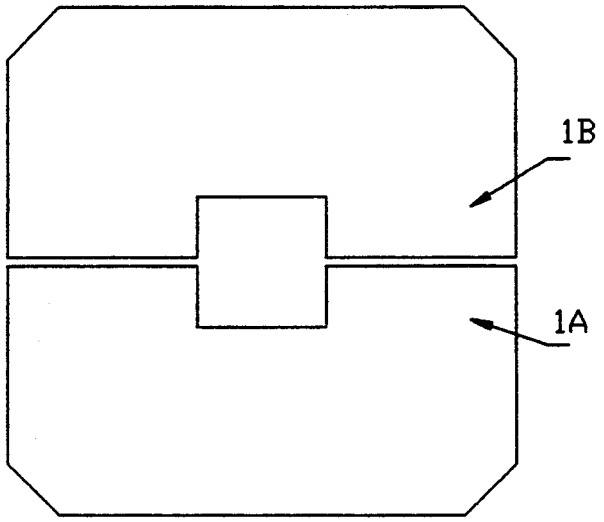
FIG. 2(*a*) a top plan view and FIG. 2(*b*) a side perspective view of the invention, for use on a kelly with a square drill; it is driven by the square shoulders of the master bushing the master bushing.
Figure 2B:
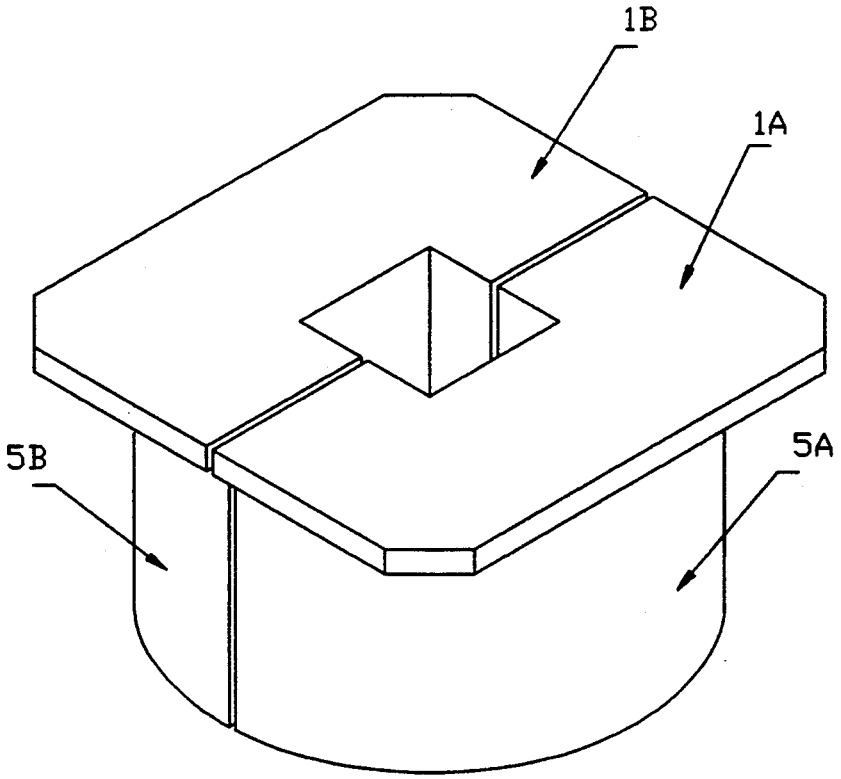

In the alternative, FIG. 2 shows a split, drive bushing-drive plate (1A, 1B) with a cylindrical extension block (5A, 5B) to match the master bushing of the rotary table, a square vertical center (6A, 6B), and no pins.

Figure 3:
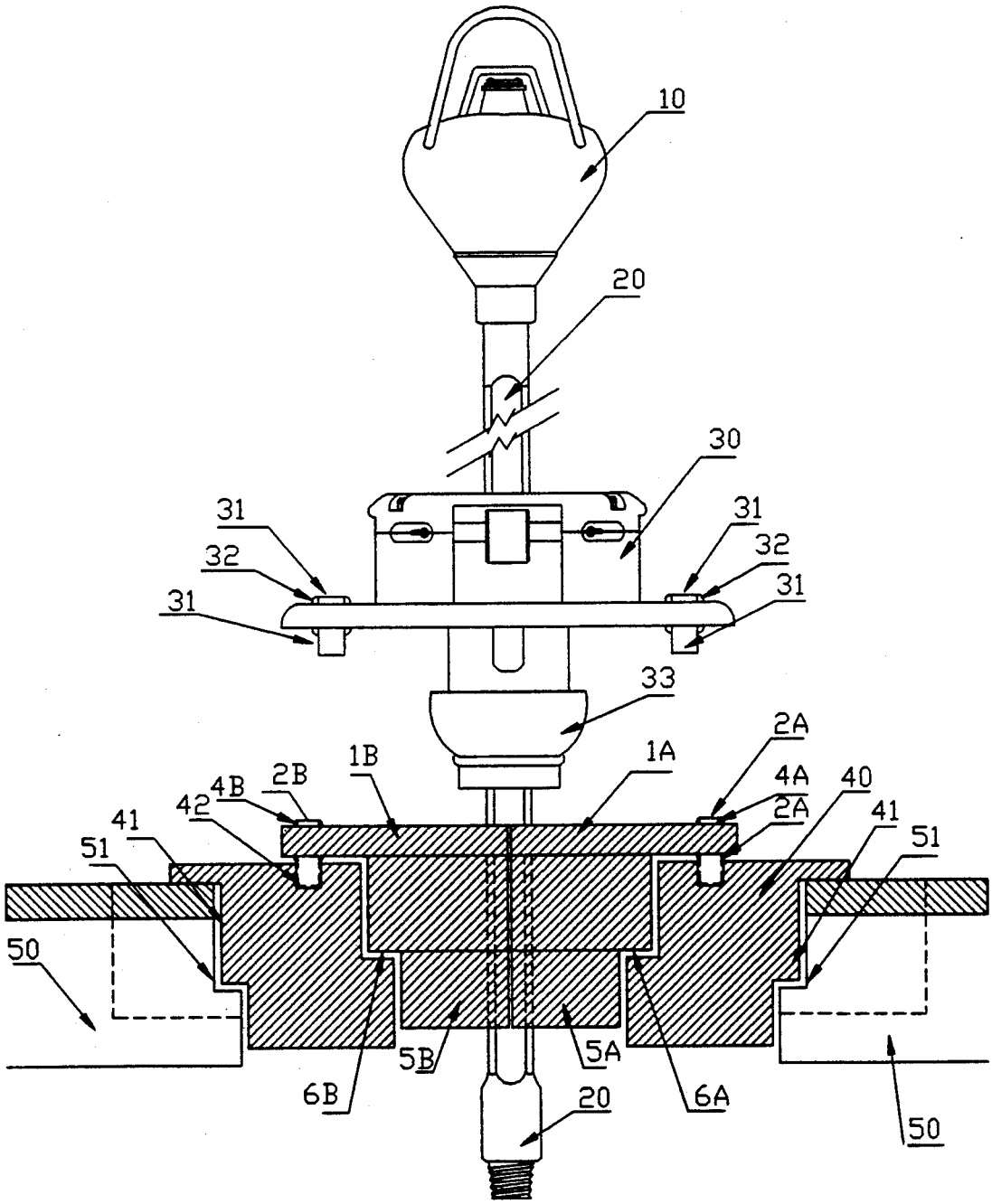
FIG. 3 is a side elevational view of the invention in place in the kelly, ready for a casing-cutting operation.

Referring to FIG. 3, the drive bushing-drive plate is shown in place in the master bushing with a hexagonal kelly. The pins of the drive bushing-drive plate (2A, 2B are shown, 3A, 3B are behind them) rest in the pin holes (42) of the master bushing (40). The shoulder of the drive bushing-drive plate (6A, 6B) rests against the ledge of the master bushing (40). The drive bushing-drive plate fits around the hexagonal kelly (20). The kelly drive (30), which normally drives the kelly [the drive pins (31) would normally be inserted into the pin holes (42) in the master bushing] has been raised and the drive bushing-drive plate inserted in its place. After the drive bushing-drive plate is in place, the kelly drive (30) is lowered until the centralizer (33) rests on the drive bushing-drive plate.

I claim as my invention:

1. In a casing-cutting operation, wherein a master bushing with pin holes and a ledge is disposed in a rotary table and a kelly drive with pins is lowered onto the master bushing, which rotates a kelly to cut casing, a combination including the kelly drive, the master bushing, the kelly and a split, solid mass, drive bushing-drive plate disposed in the master bushing of the rotary table and below the kelly drive, said drive bushing-drive plate comprising: a split body member having an upper configuration of a drive plate, with four drive pins welded into place, one at each corner of the drive plate, and calibrated to fit into the pin holes in the master bushing of the rotary table, and a lower configuration of a cylindrical extension block with a shoulder cast to fit the ledge of the master bushing in the rotary table, said body member having a hexagonal, vertical opening at its central axis, said opening calibrated in size to engage the outer contours of the kelly, said body member thereupon driving the kelly during the casing-cutting operation, with increased surface area contacting the outer contours of the kelly, resulting in reduced wear on the kelly.

2. In a casing-cutting operation, wherein a master bushing with a ledge is disposed in a rotary table and a kelly drive is lowered onto the master bushing, which rotates a kelly to cut casing, a combination with the kelly drive, the master bushing, the kelly and a split, solid mass, drive bushing-drive plate disposed in the master bushing of the rotary table and below the kelly drive, said drive bushing-drive plate comprising: a split body member having an upper configuration of a drive plate, and a lower configuration of a cylindrical extension block cast to fit the ledge of the master bushing in the rotary table, said body member having a square, vertical opening at its central axis, said opening calibrated in size to engage the outer contours of the kelly, said body member thereupon driving the kelly during the casing-cutting operation, with increased surface area contacting the outer contours of the kelly, resulting in reduced wear on the kelly.

* * * * *